US005660075A

United States Patent [19]

Johnson et al.

[11] Patent Number: 5,660,075

[45] Date of Patent: Aug. 26, 1997

[54] WIRE DRAWING DIE HAVING IMPROVED PHYSICAL PROPERTIES

[75] Inventors: David M. Johnson, Westerville; Jon L. Helgeland, Gahanna, both of Ohio

[73] Assignee: General Electric Company, Worthington, Ohio

[21] Appl. No.: 412,050

[22] Filed: Mar. 28, 1995

[51] Int. Cl.[6] ..... B21C 3/02

[52] U.S. Cl. ..... 72/467

[58] Field of Search ..... 72/467

[56] References Cited

U.S. PATENT DOCUMENTS

| | | | |
|---|---|---|---|
| 1,939,768 | 12/1933 | De Bats | 72/467 |
| 2,150,734 | 3/1939 | Unckel | 72/467 |
| 3,178,925 | 4/1965 | Nolan | 72/467 |
| 3,433,049 | 3/1969 | Naeser | 72/467 |
| 3,831,428 | 8/1974 | Wentorf, Jr. et al. | 72/467 |
| 4,016,736 | 4/1977 | Carrison et al. | 72/467 |
| 4,129,052 | 12/1978 | Bieberich | 72/467 |
| 4,144,739 | 3/1979 | Corbin | 72/467 |
| 4,303,442 | 12/1981 | Hara et al. . | |
| 4,370,149 | 1/1983 | Hara et al. | 51/309 |
| 4,374,900 | 2/1983 | Hara et al. | 428/551 |
| 4,534,934 | 8/1985 | Cho | 51/309 |
| 4,778,486 | 10/1988 | Csillag et al. | 51/309 |
| 4,797,326 | 1/1989 | Csillag | 428/552 |
| 4,828,611 | 5/1989 | Nakai et al. . | |
| 4,872,333 | 10/1989 | Burnand | 72/467 |
| 4,954,139 | 9/1990 | Cerutti . | |
| 5,033,334 | 7/1991 | Phaal et al. | 76/107.4 |
| 5,273,557 | 12/1993 | Cerutti et al. | 51/293 |

FOREIGN PATENT DOCUMENTS

| | | | |
|---|---|---|---|
| 8517 | 1/1991 | Japan | 72/467 |
| 462036 | 3/1937 | United Kingdom | 72/467 |

*Primary Examiner*—Daniel C. Crane

[57] ABSTRACT

A wire drawing die having improved physical properties, and a blank therefor. A cemented metal carbide support component having a lengthwise extent is provided to extend radially about a central longitudinal axis to define an internal bore therethrough. For receiving the wire to be drawn through an internal thereof, a sintered polycrystalline compact component is received within the bore of the support component. The compact component is bonded to the support component at an interface surface extending along the longitudinal axis from a first end spaced a first local maximum radial distance from the axis to a second end spaced a second local maximum radial distance from the axis. The interface surface is radially symmetrical about the longitudinal axis and extends radially inwardly from the first and the second end to define an intermediate region therebetween spaced a local minimum radial distance from the axis.

22 Claims, 2 Drawing Sheets

WIRE DRAWING DIE HAVING IMPROVED PHYSICAL PROPERTIES

BACKGROUND OF THE INVENTION

The present invention relates to wire drawing dies, and more particularly to dies formed of a cemented metal carbide supported, polycrystalline diamond (PCD) or polycrystalline cubic boron nitride (PCBN) compact wherein a non-cylindrical interface is provided between the compact and support layers for improved physical properties.

A compact may be characterized generally as an integrally-bonded structure formed of a sintered, polycrystalline mass of abrasive particles, such as diamond or CBN. Although such compacts may be self-bonded without the aid of a boning matrix or second phase, it generally is preferred, as is discussed in U.S. Pat. Nos. 4,063,909 and 4,601,423, to employ a suitable bonding matrix which usually is a metal such as cobalt, iron, nickel, platinum, titanium, chromium, tantalum, copper, or an alloy or mixture thereof. The bonding matrix, which is provided at from about 5% to 35% by volume, additionally may contain a recrystallization or growth catalyst such as aluminum for CBN or cobalt for diamond.

For many applications, it is preferred that the compact is supported by its bonding to substrate material to form a laminate or supported compact arrangement. Typically, the substrate material is provided as a cemented metal carbide which comprises, for example, tungsten, titanium, or tantalum carbide particles, or a mixture thereof, which are bonded together with a binder of between about 6% to about 25% by weight of a metal such as cobalt, nickel, or iron, or a mixture or alloy thereof. As is shown, for example, in U.S. Pat. Nos. 3,381,428; 3,852,078; and 3,876,751, compacts and supported compacts have found acceptance in a variety of applications as parts or blanks for cutting and dressing tools, as drill bits, and as wear parts or surfaces.

The basic HP/HT method for manufacturing the polycrystalline compacts and supported compacts of the type herein involved entails the placing of an unsintered mass of abrasive, crystalline particles, such as diamond or CBN, or a mixture thereof, within a protectively shielded metal enclosure which is disposed within the reaction cell of a HT/HP apparatus of a type described further in U.S. Pat. Nos. 2,947,611; 2,941,241; 2,941,248; 3,609,818; 3,767,371; 4,289,503; 4,673,414; and 4,954,139. Additionally placed in the enclosure with the abrasive particles may be a metal catalyst if the sintering of diamond particles is contemplated, as well as a pre-formed mass of a cemented metal carbide for supporting the abrasive particles and to thereby form a supported compact therewith. The contents of the cell then are subjected to processing conditions selected as sufficient to effect intercrystalline bonding between adjacent grains of the abrasive particles and, optionally, the joining of the sintered particles to the cemented metal carbide support. Such processing conditions generally involve the imposition for about 3 to 120 minutes of a temperature of at least 1300° C. and a pressure of at least 20 kbar.

Regarding the sintering of polycrystalline diamond compacts or supported compacts, the catalyst metal may be provided in a pre-consolidated form disposed adjacent the crystal particles. For example, the metal catalyst may be configured as an annulus into which is received a cylinder of abrasive crystal particles, or as a disc which is disposed above or below the crystalline mass. Alternatively, the metal catalyst, or solvent as it is also known, may be provided in a powdered form and intermixed with the abrasive crystalline particles, or as a cemented metal carbide or carbide molding powder which may be cold pressed in to shape and wherein the cementing agent is provided as a catalyst or solvent for diamond recrystallization or growth. Typically, the metal catalyst or solvent is selected from cobalt, iron, or nickel, or an alloy or mixture thereof, but other metals such as ruthenium, rhodium, palladium, chromium, manganese, tantalum, copper, and alloys and mixtures thereof also may be employed.

Under the specified HT/HP conditions, the metal catalyst, in whatever form provided, is caused to penetrate or "sweep" into the abrasive layer by means of either diffusion or capillary action, and is thereby made available as a catalyst or solvent for recrystallization or crystal intergrowth. The HT/HP conditions, which operate in the diamond stable thermodynamic region above the equilibrium between diamond and graphite phases, effect a compaction of the abrasive crystal particles which is characterized by intercrystalline diamond-to-diamond bonding wherein parts of each crystalline lattice are shared between adjacent crystal grains. Preferably, the diamond concentration in the compact or in the abrasive table of the supported compact is at least about 70% by volume. Methods for making diamond compacts and supported compacts are more fully described in U.S. Pat. Nos. 3,141,746; 3,745,623; 3,609,818; 3,850,591; 4,394,170; 4,403,015; 4,797,326; and 4,954,139.

Regarding the sintering of polycrystalline CBN compacts and supported compacts, such compacts and supported compacts are manufactured in general accordance with the methods suitable for diamond compacts. However, in the formation of CBN compacts via the previously described "sweep-through" method, the metal which is swept through the crystalline mass need not necessarily be a catalyst or solvent for CBN recrystallization. Accordingly, a polycrystalline mass of CBN may be joined to a cobalt-cemented tungsten carbide substrate by the sweep through of the cobalt from the substrate and into the interstices of the crystalline mass notwithstanding that cobalt is not a catalyst or solvent for the recrystallization of CBN. Rather, the interstitial cobalt functions as a binder between the polycrystalline CBN compact and the cemented tungsten carbide substrate.

As it was for diamond, the HT/HP sintering process for CBN is effected under conditions in which CBN is the thermodynamically stable phase. It is speculated that under these conditions, intercrystalline bonding between adjacent crystal grains also is effected. The CBN concentration in the compact or in the abrasive table of the supported compact is preferably at least about 50% by volume. Methods for making CBN compacts and supported compacts are more fully described in U.S. Pat. Nos. 2,947,617; 3,136,615; 3,233,988; 3,743,489; 3,745,623; 3,831,428; 3,918,219; 4,188,194; 4,289,503; 4,673,414; 4,797,326; and 4,954,139. Exemplary CBN compacts are disclosed in U.S. Pat. No. 3,767,371 to contain greater than about 70% by volume of CBN and less than about 30% by volume of a binder metal such as cobalt.

As is described in U.S. Pat. No. 4,334,928, yet another form of a polycrystalline compact, which form need not necessarily exhibit direct or intercrystalline bonding, involves a polycrystalline mass of diamond or CBN particles having a second phase of a metal or alloy, a ceramic, or a mixture thereof. The second material phase is seen to function as a bonding agent for the abrasive crystal particles. Polycrystalline diamond and polycrystalline CBN compacts containing a second phase of a cemented carbide are exemplary of these "conjoint" polycrystalline abrasive compacts. Such compacts may be considered to be "thermally-stable" as compared to metal-containing compacts as having service temperatures above about 700° C. Compacts as those described in U.S. Pat. No. 4,334,928 to comprise 80 to 10% by volume of CBN and 20 to 90% by volume of a nitride binder such as titanium nitride also may be considered exemplary of a thermally-stable material.

Supported PCD and CBN compacts have garnered wide acceptance for use in cutting and dressing tools, drill bits, and in like applications wherein the hardness and wear properties of such compacts are exploited. In particular, such compacts have been incorporated into dies for drawing feedstocks of such metals as tungsten, copper, iron, molybdenum, and stainless steel into wires. Typically, these wire drawing dies are configured as a generally cylindrical, inner mass of a PCD or CBN compact surrounded by and bonded to an generally annular, outer mass of a metal carbide support. Provided to extend through the compact along the axial centerline thereof is a hole or other aperture into which the metal feedstock is drawn for its elongation into a wire product of a reduced diameter. Wire drawing dies of such general type and methods for manufacturing the same are described in U.S. Pat. Nos. 3,831,428; 4,016,736; 4,129,052; 4,144,739; 4,303,442; 4,370,149; 4,374,900; 4,534,934; 4,828,611; 4,872,333; and 5,033,334.

With respect to the fabrication of the wire drawing dies herein involved, although a variety of methods may be employed, HT/HP sintering processes as are described in U.S. Pat. Nos. 3,831,428 and 4,534,934 may be considered preferred. As with the fabrication of supported compacts in general, the preferred HT/HP processes entail the sweep of a catalytic or binder metal, such as cobalt, through a mass of CBN or PCD particles. For wire die forming processes, the particles are charged within a support of a surrounding metal carbide annulus. At the processing conditions heretofore specified, metal from the support and, optionally, from an axially disposed disc, is made to infiltrate radially and/or axially into the interstices of the crystalline mass. Within the particle mass, the infiltrated metal forms a separate binder phase and, at least with respect to PCD, effects significant intercrystalline bonding. The metal additionally joins the sintered compact to the support to form an integral structure. The wire drawing hole may be formed through the sintered compact as a finishing step by laser drilling or other machining techniques. Alternatively, the hole may be pre-formed by including a wire as axially disposed within the particle mass, which wire is removed after the sintering of the mass by dissolution in a suitable acid or other solvent or by machining techniques.

As to supported compacts in general, it is speculated, as is detailed in U.S. Pat. No. 4,797,326, that the bonding of the support to the polycrystalline abrasive mass involves a physical component in addition to a chemical component which develops at the bondline if the materials forming the respective layers are interactive. The physical component of bonding is seen to develop from the relatively lower coefficient of thermal expansion (CTE) of the polycrystalline abrasive layer as compared to the cemented metal support layer. That is, upon the cooling of the supported compact blank from the HT/HP processing conditions to ambient conditions, it has been observed that the support layer retains residual tensile stresses which, in turn, exert a radial compressive loading on the polycrystalline compact supported thereon. This loading maintains the polycrystalline compact generally in compression which thereby improves the fracture toughness, impact, and shear strength properties of the laminate. In a wire die configuration, the support annulus has been observed, generally, to beneficially exert both an radial and an axial compression against the central polycrystalline core. However, localized regions of residual tensile stress are known to be present in the throat or reduction zone of the wire die.

During drawing operations, however, there are known to be developed frictional normal forces as between the contacting surfaces of the die and the wire being drawn. Such forces develop stresses which have been observed to combine with the residual stresses from the HT/HP forming process to deleteriously affect the operational life and performance properties of the die. Failure has been seen to occur principally within the bore of the die, or at the external, i.e., axial, surfaces of the compact layer.

Moreover, in the commercial production of supported compacts in general, it is common for the product or blank which is recovered from the reaction cell of the HT/HP apparatus to be subjected to a variety or finishing operations which include cutting, such as by electrode discharge machining or with lasers, milling, and especially grinding to remove any adherent shield metal from the outer surfaces of the compact. Such operations additionally are employed to machine the compact into a cylindrical shape or the like which meets product specifications as to diamond or CBN abrasive table thickness and/or carbide support thickness. With respect to wire drawing dies in particular, prior to use, the die generally is brazed into a receiving ring or other support assembly. It will be appreciated, however, that during such finishing and brazing operations, the temperature of the blank, which previously had been exposed to a thermal cycle during its HT/HP processing and cooling to room temperature, can be elevated due to the thermal effects of the operations. During each of the thermal cyclings, the carbide support, owing to its relatively higher coefficient of thermal expansion (CTE), will have expanded to a greater extent than the abrasive compact supported thereon. Upon heating and cooling, the stresses generated are relieved principally through the deformation of the compact layer which may result in its stress cracking and delamination from its support.

Proposals have been made to improve the performance of supported compact wire drawing dies. In this regard, U.S. Pat. No. 4,374,900 suggests surrounding the circumference of the diamond compact with a cermet material which contains molybdenum as a predominant component. The cermet is stated to have a high degree of plastic deformation and a high rigidity at elevated temperatures. U.S. Pat. No. 5,033,334 discloses a wire drawing die wherein the outer surface of the compact is metallized and then brazed to the mating surface of the support. Such die is stated to have an improved bond strength as between the compact and support components.

Notwithstanding the prior proposals, additional improvements in wire drawing dies would be well-received by industry. Especially desired would be a die having reduced residual stresses and, correspondingly, an extended service life, a reduced susceptibility to failure, and improved machinability, performance, and wear properties. Thus, there has been and heretofore has remained a need for wire drawing dies having improved physical properties.

BROAD STATEMENT OF THE INVENTION

The present invention is directed to wire drawing dies and blanks therefor, and to a method of making the same, and more particularly to wire drawing dies having improved physical properties wherein an inner compact component is bonded to an outer support component at a generally non-cylindrical, interface. As is illustrated in U.S. Pat. Nos. 3,831,428; 4,016,736; 4,129,052; 4,144,739; 4,303,442; 4,370,149; 4,374,900; 4,534,934; 4,828,611; 4,872,333; and 5,033,334, the wire drawing dies heretofore known in the art have been characterized as having a cylindrical interface as between an inner compact mass and an outer, generally annular support component. However, it has been discovered that by providing a non-cylindrical interface as between the compact and support components, an improvement in the ultimate physical and performance properties of the die may be realized.

It therefore is a feature of the present invention to provide an improved wire drawing die. The die includes a cemented metal carbide support component which has a lengthwise extent and which extends radially about a central longitudinal axis to define an internal bore therethrough. For receiving the wire to be drawn through an internal aperture thereof, a sintered polycrystalline compact component is received within the bore of the support component. The compact component is bonded during a high pressure/high temperature (HT/HP) forming process to the support component at an interface surface extending along the longitudinal axis from a first end spaced a first local maximum radial distance from the axis to a second end spaced a second local maximum radial distance from the axis. The interface surface is radially symmetrical about the longitudinal axis and extends radially inwardly from the first and the second end to define an intermediate region therebetween spaced a local minimum radial distance from the axis.

It is a further feature of the invention to provide a blank for an improved wire die. The blank includes a metal carbide support component which has a lengthwise extent and which extends radially about a central longitudinal axis to define an internal bore therethrough. A sintered polycrystalline compact component is received within the bore of the support component. The compact component is bonded to the support component at an interface surface which extends along the longitudinal axis from a first end spaced a first local maximum radial distance from the axis to a second end spaced a second local maximum radial distance from the axis. The interface surface is radially symmetrical about the longitudinal axis and extends radially inwardly from the first and the second end to define an intermediate region therebetween spaced a local minimum radial distance from the axis.

It is yet a further feature of the invention to provide a high pressure/high temperature (HP/HT) method for making a blank for a wire drawing die. In accordance with this method, a reaction cell assembly is provided to include a cemented metal carbide support component and sinterable mass of crystalline particles. The support component has a lengthwise extent and extends radially about a central longitudinal axis to define an internal bore therethrough. The sinterable mass of crystalline particles is received within the bore of the support component. The reaction cell assembly provided then is subjected to HT/HP conditions selected as being effective to sinter the mass of crystalline particles into a polycrystalline compact, and to bond the compact to the support component at an interface surface extending along the longitudinal axis from a first end spaced a first local maximum radial distance from the axis to a second end spaced a second local maximum radial distance from the axis. The interface surface is radially symmetrical about the longitudinal axis and extends radially inwardly from the first and the second end to define an intermediate region therebetween spaced a local minimum radial distance from the axis.

Advantages of the present invention include the provision of a wire drawing die, and of a blank therefor, having residual stresses which are controlled to promote an extended service life, a reduced susceptibility to failure, and having improved machinability, performance, and wear properties. Accordingly, the dies and blanks of the present invention are expected to be highly favored for both hard and soft wire drawing applications alike. Additional advantages of the present invention include wire drawing dies and blanks having higher service temperatures, and which facilitate machining, brazing, or other finishing processes in conformance with product specifications with a reduced risk of stress cracking, delamination, or the like. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
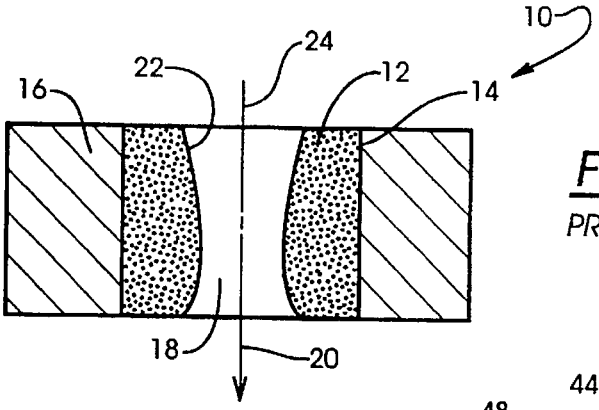
FIG. 1 PRIOR ART
FIG. 1 is a cross-sectional view of a wire drawing die fabricated in accordance with the prior art as having a generally cylindrical interface as between an inner compact and an outer support component.

Referring to FIG. 1, a wire drawing die substantially in accordance with the prior art is shown at 10 to include an inner, polycrystalline compact component, 12, bonded at an interface or bondline, 14, to a cemented metal carbide support layer, 16. A wire drawing aperture or throat, represented at 18, is provided to extend through compact component 12 for receiving the wire being drawn. In this regard, a wire feedstock (not shown) of a given diameter is drawn through aperture 18 in the direction shown by arrow 20 for elongation into a wire product of a reduced diameter. Drawing aperture 18 preferably is configured as being tapered either doubly or piecewise to define a characteristic surface of revolution, 22, about a central longitudinal axis, 24, for confronting the wire being drawn. Alternatively, aperture 18 may be more conventionally provided as defining a generally cylindrical surface of revolution about axis 24.

As heretofore has been typical in the art, interface 14 is provided as being generally linear in cross-section, and defined as a generally cylindrical surface of revolution about a central longitudinal axis 24. However, dies of the conventional configuration as at 10 are known to have service lives which may be prematurely shortened from stress cracking or other failure. Principally, failure has been observed to occur within the throat region of drawing aperture 18, such as on surface 22 thereof. It is speculated that during drawing operations, normal and frictional forces are developed as between the contacting surfaces of aperture 18 and the wire being drawn. Such forces develop stresses which are combined with the residual stresses in compact component 12 developed during the HT/HP processing thereof to exceed the shear and/or tensile strength of the compact material.

Figure 2:
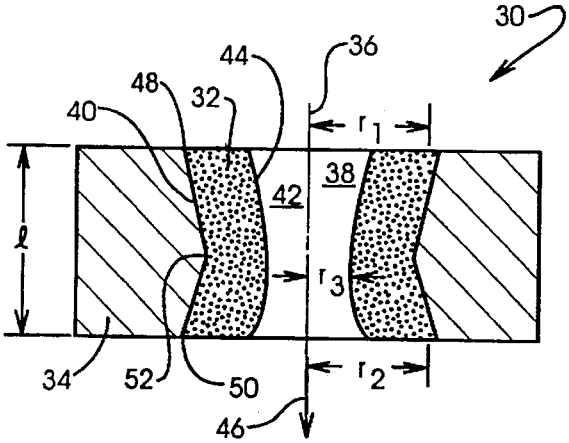
FIG. 2 is a cross-sectional view of a wire drawing die fabricated in accordance with the present invention as having a generally non-cylindrical interface as between an inner compact and an outer support component.

Referring then to FIG. 2, a wire drawing die according to the present invention is shown generally at 30 to include an inner, sintered polycrystalline compact component, 32, and an outer, support component, 34. Support component 34 is configured as having a lengthwise extent, l, and as extending about a central longitudinal axis, 36, to define and internal bore, 38, therethrough. Compact component 32 is received within bore 38 of support component 34, and is bonded thereto at an interface surface, 40. As before a wire drawing aperture or throat, represented at 42, defining a generally tapered surface of revolution, 44, about axis 36, is provided to extend through compact component 32 for receiving a wire (not shown) drawn therethrough in the direction shown at arrow 46. However, interface surface 40 now extends along axis 36 from a first end, 48, spaced a first local maximum radial distance, $r_1$, from axis 36, to a second end, 50, spaced a second local maximum radial distance, $r_2$, from axis 36. Although radial distances $r_1$ and $r_2$ are shown for purposes of illustration as being substantially equal, other relationships therebetween may be provided.

In accordance with the precepts of the present invention, interface 40 is configured as being radially symmetrical about longitudinal axis 36, and to extend radially inwardly from first end 48 and second end 50 to define an intermediate region, shown at 52, spaced a local minimum radial distance, $r_3$, from axis 36. That is, in cross-section, interface 40 is characterized as being axisymmetric but non-linear in sloping radially inwardly from ends 48 and 50 toward throat or aperture 42. By non-linear, it is meant that interface 40 is non-cylindrical and includes segmented or piecewise linear (See FIGS. 3B and 3C), as well as curvilinear (See FIG. 3A) geometries. The slope of interface 40 from first end 48 and second end 50 to intermediate region 52 may be selected as a function of the diameter of bore 42, with a limit being reached for any given diameter beyond which the physical properties of die 30 may begin to be deleteriously affected.

Without being bound by theory, it is speculated that the described configuration of interface 40 effects a controlled reduction in residual tensile stresses on certain critical surfaces of compact 32, such as inner surface 44. That is, all wire dies have inherent residual stresses which are developed as a result of the HT/HP forming process. Tensile stresses in the compact layer, and particularly in the bore or throat region thereof, are especially undesirable. However, modifications of the interface geometry between the compact and support layers in the manner described herein have been found to reduce the tension in the bore of the die. Such a reduction, it will be appreciated, would lead to a die 30 having an expected increased service life, a reduced susceptibility to failure, especially in the bore, and improved machinability, performance, and wear properties.

Figure 4A:
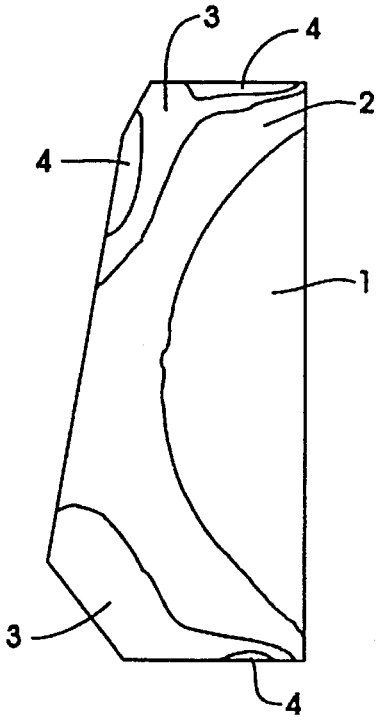
FIG. 4A is a graphical representation of a finite element model of the maximum principle stress distributions in a section of a wire die compact having a conventional cylindrical interface.
Figure 4B:
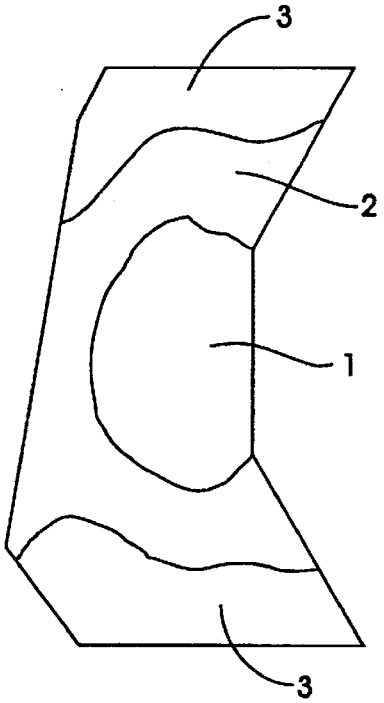
FIG. 4B is a graphical representation of a finite element model of the maximum principle stress distributions in a section of a wire die compact having a non-cylindrical interface according to the present invention.
Figure 5A:
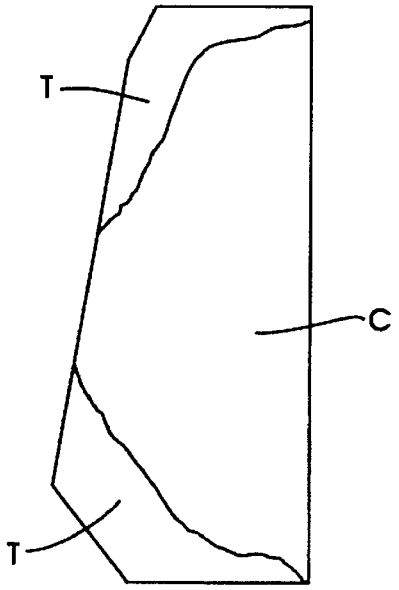
FIG. 5A is a graphical representation of a finite element model of the tension and compression regions in a section of a wire die compact having a conventional cylindrical interface.
Figure 5B:
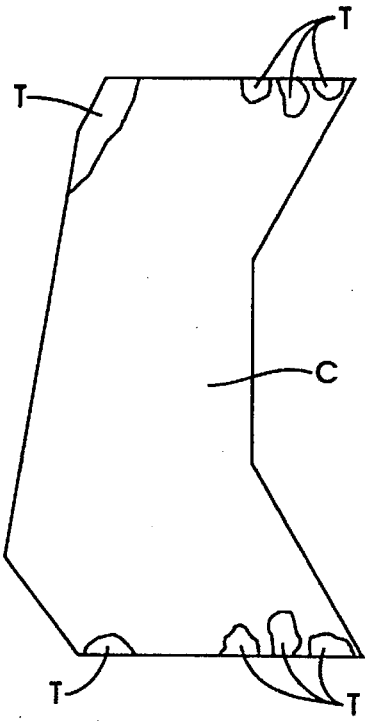
FIG. 5B is a graphical representation of a finite element model of the tension and compression regions in a section of a wire die compact having a non-cylindrical interface according to the present invention.

In this regard, reference may be had to FIGS. 4A and 4B wherein a somewhat stylized representation of a finite element model of the maximum principle stress distributions in a section of a wire die compact are shown for a generally cylindrical interface, FIG. 4A, and for a generally non-cylindrical interface, FIG. 4B, according to the present invention. Each of the sections are shown as having a maximum principle stress distribution graphically depicted by the contours designated 1–4 representing, respectively, stresses increasing to the tensile region. From the figures, it may be appreciated that the bore region of the die of FIG. 4B having the non-cylindrical interface of the present invention shows to have developed relatively less tensile stresses as compared to the bore region of the die of FIG. 4A having a conventional cylindrical interface. These same results are shown in FIGS. 5A and 5B wherein die sections as in FIGS. 4A and 4B are delineated only with the tension and compression contours designated, respectively, "T" and "C". Again, the bore region of the die of FIG. 5B having the non-cylindrical interface of the present invention shows to be under relatively less tension as compared to the bore region of the die of FIG. 4A having a conventional cylindrical interface.

Figure 3A:
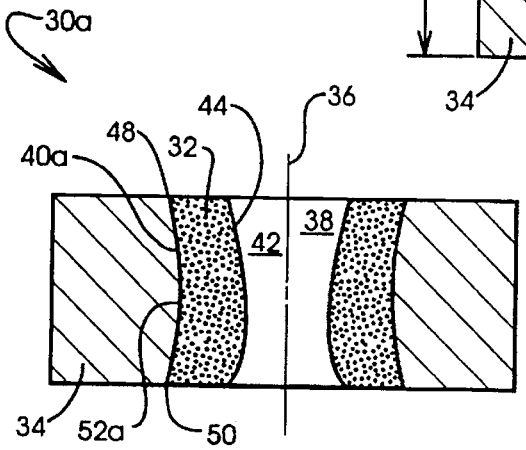
FIGS. 3A–C are cross-sectional views of alternative embodiments of the wire drawing die of FIG. 2.
Figure 3B:
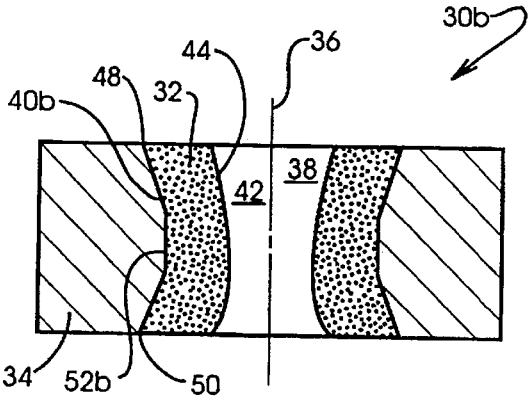
Figure 3C:
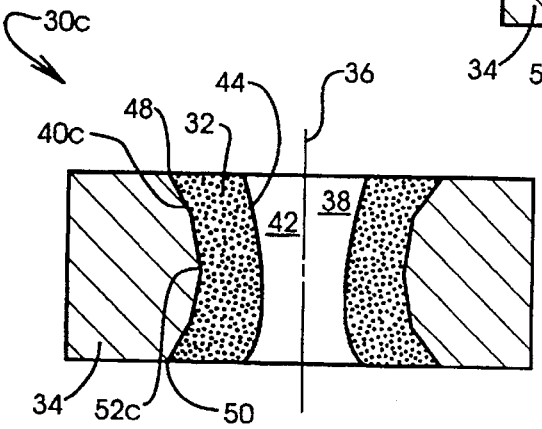

Returning to FIG. 2, as is shown, intermediate region 52 of interface 40 of the present invention may be configured as defining a generally circular locus of revolution about axis 36. Alternative configurations of interface 40 and intermediate region 52 thereof may be envisioned, however, representative embodiments of which are illustrated, respectively, at **30*a–c* in FIGS. 3A–C. In this regard, FIG. 3A depicts interface surface 40*a* and intermediate region 52*a* thereof as extending from first end 48 to second end 50 as defining a generally hyperbolic surface of revolution about central longitudinal axis 36. FIG. 3B, in turn, depicts intermediate region 52*b* of interface 40*b* as defining a generally cylindrical surface of revolution about axis 36. In like manner, FIG. 3C depicts intermediate region 52*c* of interface 40*c* as defining a generally tapered, i.e., segmented or piecewise hyperbolic, surface of revolution about axis 36. of course, still other geometries may be envisioned wherein interface 40 extends radially inwardly from a first and second end to define an intermediate region 52 spaced a local minimum radial distance from longitudinal axis 36**. Such other geometries, of course, are to be considered to be within the scope of the present invention.

Returning to FIG. 2, it is preferable that compact 32 is provided as a mass of crystalline diamond particles having, for example, an average particle size distribution between about less than a micron to about 100 microns. As is conventional in the art, the mass may be sintered under HT/HP processing conditions to form an integral compact bonded to support component 34. By "bonded," it generally is meant that compact component 32 is directly, i.e., integrally, joined chemically and/or physically to a support component 34 under the HT/HP processing conditions without means of a braze alloy filler layer or the like. However, the introduction of a braze filler metal, such as an alloy of silver, copper, titanium, palladium, platinum, zinc, nickel, gold, or manganese, or a mixture thereof, between the compact and support component also to be considered to be within the precepts of the present invention. Brazing techniques are described more fully in U.S. Pat. Nos. 4,063,909; 4,225,322; 4,319,707; 4,527,998; 4,601,423; 4,670,025; 4,772,294; 4,850,523; 4,941,891; 4,968,326; 4,931,363; 5,032,147; and 5,273,557.

Broadly, cemented metal carbide support component 34 is selected as comprising particles of a metal carbide, such as tungsten carbide, titanium carbide, tantalum carbide, and molybdenum carbide, and mixtures thereof, held within a metal binder, such as cobalt, nickel, and iron, or a mixture or an alloy thereof, which is provided at about 6% to 25% by weight. For effecting the HP/HT sintering of the preferred diamond particles forming compact component 32, however, it is preferred that the binder metal is provided as a diamond catalyst or solvent such as cobalt, iron, nickel, ruthenium, rhodium, palladium, platinum, chromium, manganese, tantalum, osmium, iridium, or a mixture or alloy thereof, with cobalt or a cobalt alloy or mixture being favored for performance and processing considerations.

Advantageously, die 30 of the present invention may be manufactured in a conventional HT/HP apparatus which may be of the belt- or die-type described in U.S. Pat. Nos. 2,947,611; 2,941,241; 2,941,248; 3,609,818; 3,767,371; 4,289,503; 4,673,414; and 4,954,139. In this regard, the sinterable powder forming compact component 32, along with the metal carbide support component 34, may be retained in the reaction cell of the HT/HP apparatus. Although support component 34 preferably is provided in the reaction cell as a pre-formed annulus into which a cylindrical mass of diamond or CBN particles is received, a mass of a sinterable carbide powder admixed with a powdered metal binder may be substituted.

Once charged, the reaction cell then may be placed as a reaction cell assembly between the punches of the HT/HP apparatus. Alternatively, the cell may be charged into the HT/HP apparatus as one of a number of subassembly cells provided in a stacked, axially-aligned arrangement for preparing a plurality of dies or blanks therefor. Under the HT/HP conditions achieved within the HT/HP apparatus, the binder metal from the support component 34 is made to advance or "sweep" by diffusion or capillary action through the powdered crystalline mass, wherein it is made available as a binder, or as a catalyst or solvent for the recrystallization and intercrystalline growth of a sintered polycrystalline compact. To promote a uniform sweep through of the binder metal, additional binder, catalyst, or solvent metal may be admixed with or provided in a separate layer disposed adjacent to the powdered crystalline particles forming compact component 32. In general, the HT/HP conditions are applied to the reaction cell assembly for a time sufficient to effect the sintering or intercrystalline bonding of the PCD or CBN particles forming compact component 32 into integral abrasive bodies or polycrystalline compacts which are essentially free of voids, and to effect the direct bonding of these compacts to support component 34. Advantageously, the direct bonding relationship obviates the need for the interposition of an additional bonding layer therebetween, as would result from the brazing or soldering of the components. The compact formed generally will be observed to comprise from between about 5% to about 35% by volume of binder metal.

Broadly, the HT/HP conditions under which the HT/HP apparatus is made to operate are selected as being within the thermodynamic region wherein diamond and/or CBN are the stable phases, and whereat significant reconversion, i.e., graphitization, of the crystalline diamond or CBN particles does not occur. In this regard, the apparatus is operated at a temperature of at least about a 1000° C., but preferably from between about 1000° C. to about 2000° C., and at a pressure of at least about 30 kbar, but preferably from between about 40 to about 80 kbars. It should be noted, however, that the preferred temperatures and pressures specified herein are estimates only due to the difficulties attending the accurate and precise measurement of the high temperatures and pressures necessary for diamond or CBN processing. In addition, the pressure and temperature values specified need not remain constant during processing, but may be varied to define predetermined heating, cooling, and/or pressure schedules. It is known that such variances may affect the ultimate physical properties of the resulting product.

As is known in the art, wire drawing aperture 42 may be formed through compact component 32 as a finishing step by laser drilling or other machining techniques. Thus, it will be understood that a precept of the present invention is to provide a blank for forming an improved wire drawing die, such blank having the described composite structural arrangement, but as being generally cylindrical in overall configuration. Alternatively, the aperture may be pre-formed by including a wire or the like which is axially disposed within the particle mass prior to its processing at the contemplated HT/HP processing conditions. The wire may be removed after the sintering of the mass by dissolution in a suitable acid or other solvent or by a suitable machining process.

It is anticipated that certain changes may be made in the present invention without departing from the precepts herein involved. For example, although die 30 is shown as having an interface 40 which, in radial cross-section, has a generally circular periphery, other geometries, such as polygonal peripheries, are to be considered within the scope of the present invention. It therefore it is intended that all matter contained in the foregoing description shall be interpreted as illustrative and not in a limiting sense. All references cited herein are expressly incorporated by reference.

What is claimed:

1. A blank for a wire drawing die comprising:

a cemented metal carbide support component having a lengthwise extent and extending radially about a central longitudinal axis to define an internal bore through said lengthwise extent; and a sintered polycrystalline compact component received within said bore of said support component and bonded thereto at an interface surface extending along said longitudinal axis from a first end spaced a first local maximum radial distance from said axis to a second end spaced a second local maximum radial distance from said axis, said interface surface being radially symmetrical about said longitudinal axis and extending radially inwardly from said first and said second end to define an intermediate region therebetween spaced a local minimum radial distance from said axis.

2. The blank of claim 1 wherein said sintered polycrystalline compact component comprises diamond particles, CBN particles, or a mixture thereof.

3. The blank of claim 2 wherein said sintered polycrystalline compact component comprises between about 10 to 30% by volume of a binder metal selected from the group consisting of cobalt, nickel, and iron, and mixtures and alloys thereof.

4. The blank of claim 1 wherein said metal carbide support component comprises carbide particles selected from the group consisting of tungsten, titanium, tantalum, and molybdenum carbide particles, and mixtures thereof.

5. The blank of claim 1 wherein said metal carbide support component comprises a binder metal selected from the group consisting of cobalt, nickel, and iron, and mixtures and alloys thereof.

6. The blank of claim 1 wherein said intermediate region of said interface surface is defined as a generally circular locus extending radially about said longitudinal axis.

7. The blank of claim 1 wherein said intermediate region of said interface surface is defined as a generally cylindrical surface of revolution about said longitudinal axis.

8. The blank of claim 1 wherein said intermediate region is defined as a generally tapered surface of revolution about said longitudinal axis.

9. The blank of claim 1 wherein said interface surface extends from said first end to said second end as a generally hyperbolic surface of revolution about said longitudinal axis.

10. A wire drawing die comprising:

a cemented metal carbide support component having a lengthwise extent and extending radially about a central longitudinal axis to define an internal bore through said lengthwise extent; and a sintered polycrystalline compact component having an internal drawing aperture therethrough, said compact component being received within said bore of said support component and bonded thereto at an interface surface extending along said longitudinal axis from a first end spaced a first local maximum radial distance from said axis to a second end spaced a second local maximum radial distance from said axis, said interface surface being radially symmetrical about said longitudinal axis and extending radially inwardly from said first and said second end to define an intermediate region therebetween spaced a local minimum radial distance from said axis.

11. The wire drawing die of claim 10 wherein said sintered polycrystalline compact component comprises diamond particles, CBN particles, or a mixture thereof.

12. The wire drawing die of claim 11 wherein said sintered polycrystalline compact component comprises between about 10 to 30% by volume of a binder metal selected from the group consisting of cobalt, nickel, and iron, and mixtures and alloys thereof.

13. The wire drawing die of claim 10 wherein said metal carbide support component comprises carbide particles selected from the group consisting of tungsten, titanium, tantalum, and molybdenum carbide articles, and mixtures thereof.

14. The wire drawing die of claim 10 wherein said metal carbide support component comprises a binder metal selected from the group consisting of cobalt, nickel, and iron, and mixtures and alloys thereof.

15. The wire drawing die of claim 10 wherein said intermediate region of said interface surface is defined as a generally circular locus extending radially about said longitudinal axis.

16. The wire drawing die of claim 10 wherein said intermediate region of said interface surface is defined as a generally cylindrical surface of revolution about said longitudinal axis.

17. The wire drawing die of claim 10 wherein said intermediate region is defined as a generally tapered surface of revolution about said longitudinal axis.

18. The wire drawing die of claim 10 wherein said interface surface extends from said first end to said second end as a generally hyperbolic surface of revolution about said longitudinal axis.

19. The wire drawing die of claim 18 wherein said drawing aperture of said compact component defines a generally tapered surface of revolution about said longitudinal axis.

20. The wire drawing die of claim 10 wherein said drawing aperture of said compact component defines a generally tapered surface of revolution about said longitudinal axis.

21. The wire drawing die of claim 10 wherein said drawing aperture of said compact component defines a generally cylindrical surface of revolution about said longitudinal axis.

22. A blank for a wire drawing die formed by a high pressure/high temperature (HP/HT) method comprising the steps of:

(a) providing a reaction cell assembly comprising:

(i) a cemented metal carbide support component having a lengthwise extent and extending radially about a central longitudinal axis to define an internal bore through said lengthwise extent; and (ii) a sinterable mass of crystalline particles received within said bore of said support component;

(b) subjecting said reaction cell assembly to HT/HP conditions selected as being effective to sinter said mass of crystalline particles into a polycrystalline compact, and to bond said compact to said support component at an interface surface extending along said longitudinal axis from a first end spaced a first local maximum radial distance from said axis to a second end spaced a second local maximum radial distance from said axis, said interface surface being radially symmetrical about said longitudinal axis and extending radially inwardly from said first and said second end to define an intermediate region therebetween sapped a local minimum radial distance from said axis.

* * * * *